US011299813B2

(12) United States Patent
No

(10) Patent No.: US 11,299,813 B2
(45) Date of Patent: Apr. 12, 2022

(54) METHOD FOR MANUFACTURING HOLOGRAM PATTERN AND SPECIMEN INCLUDING METAL PLATING LAYER HAVING HOLOGRAM PATTERN ON SURFACE THEREOF

(71) Applicant: Seong-Tae No, Guri-si (KR)

(72) Inventor: Seong-Tae No, Guri-si (KR)

( * ) Notice: Subject to any disclaimer, the term of this patent is extended or adjusted under 35 U.S.C. 154(b) by 220 days.

(21) Appl. No.: 16/307,529

(22) PCT Filed: May 11, 2017

(86) PCT No.: PCT/KR2017/004893
§ 371 (c)(1),
(2) Date: Dec. 6, 2018

(87) PCT Pub. No.: WO2017/213353
PCT Pub. Date: Dec. 14, 2017

(65) Prior Publication Data

US 2019/0345625 A1 Nov. 14, 2019

(30) Foreign Application Priority Data

Jun. 7, 2016 (KR) ..... 10-2016-0070389

(51) Int. Cl.

| | |
|---|---|
| ***C25D 5/48*** | (2006.01) |
| ***C25D 3/12*** | (2006.01) |
| ***C25D 3/46*** | (2006.01) |
| ***C25D 3/48*** | (2006.01) |

(52) U.S. Cl.
CPC ..... *C25D 5/48* (2013.01); *C25D 3/12* (2013.01); *C25D 3/46* (2013.01); *C25D 3/48* (2013.01)

(58) Field of Classification Search
CPC ..... C25D 5/48
USPC ..... 205/220–221, 223
See application file for complete search history.

(56) References Cited

U.S. PATENT DOCUMENTS

| | | | | |
|---|---|---|---|---|
| 3,588,439 | A * | 6/1971 | Heller et al. | G03H 1/02 219/121.68 |
| 2006/0272949 | A1* | 12/2006 | Detor | C25D 3/56 205/238 |
| 2013/0323433 | A1* | 12/2013 | Lee | C25D 5/48 427/555 |

FOREIGN PATENT DOCUMENTS

| | | | |
|---|---|---|---|
| CN | 101498013 | A * | 8/2009 |
| KR | 10-2003-0035098 | | 5/2003 |
| KR | 10-2006-0114070 | | 11/2006 |
| KR | 10-2007-0053909 | | 5/2007 |
| KR | 10-0758848 | | 9/2007 |
| KR | 10-2015-0146052 | | 12/2015 |

OTHER PUBLICATIONS

Machine translation of CN101498013A. (Year: 2009).*

* cited by examiner

*Primary Examiner* — Brian W Cohen
(74) *Attorney, Agent, or Firm* — Lex IP Meister, PLLC

(57) ABSTRACT

According to a method for manufacturing a hologram pattern of the present invention, the hologram pattern is applied to a metal plating layer (not a metal specimen). Accordingly, materials which can be plated are widely applicable. The hologram pattern, which becomes appeared in various colors depending on light and user's vision, can be formed with a simple process.

6 Claims, 5 Drawing Sheets

【FIG. 1】
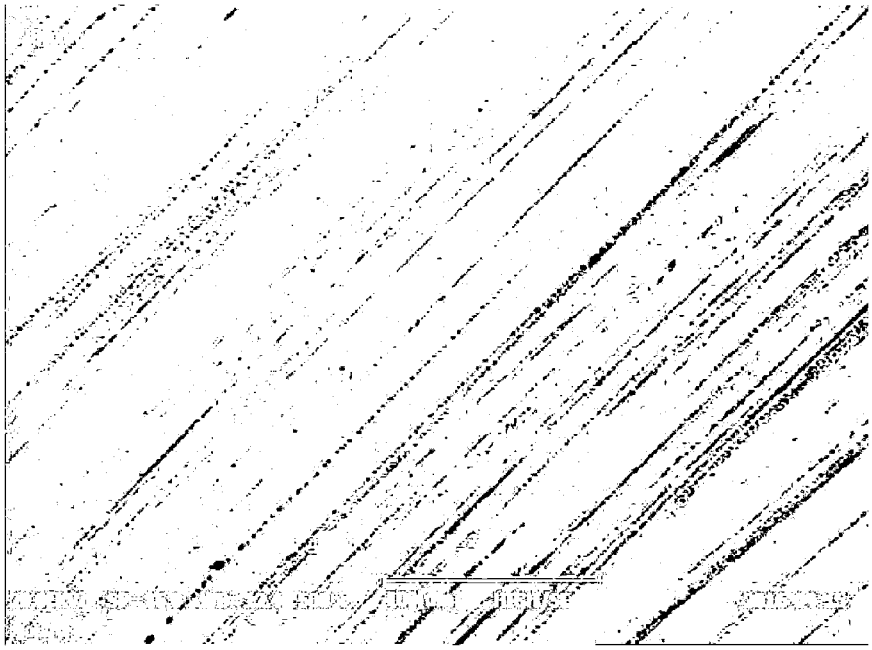
【FIG. 2】
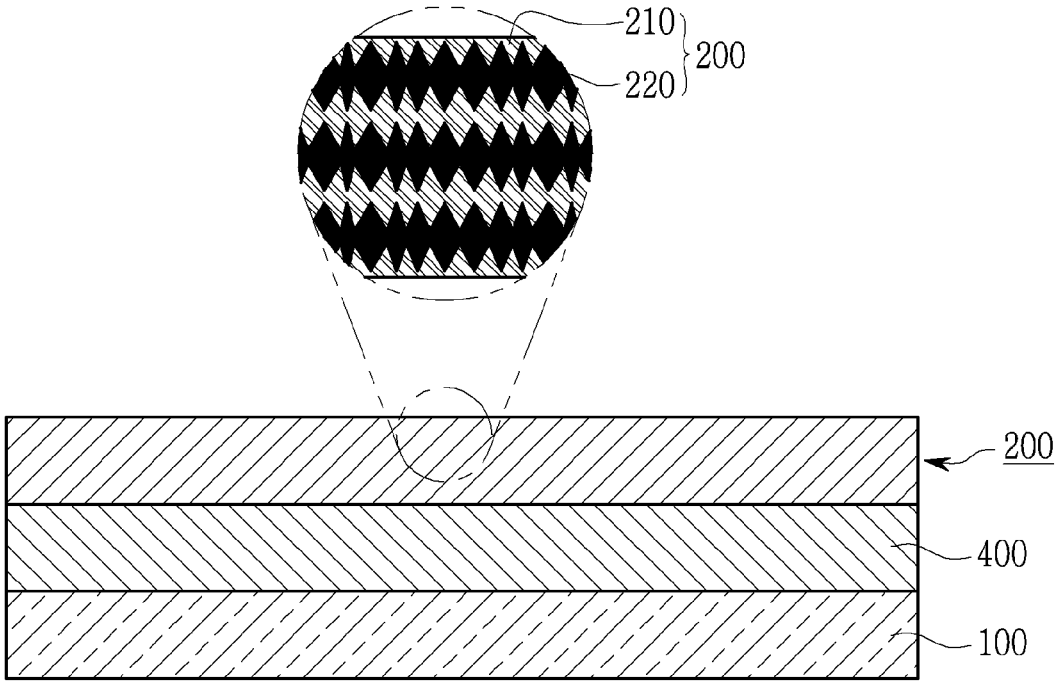

【FIG. 3】
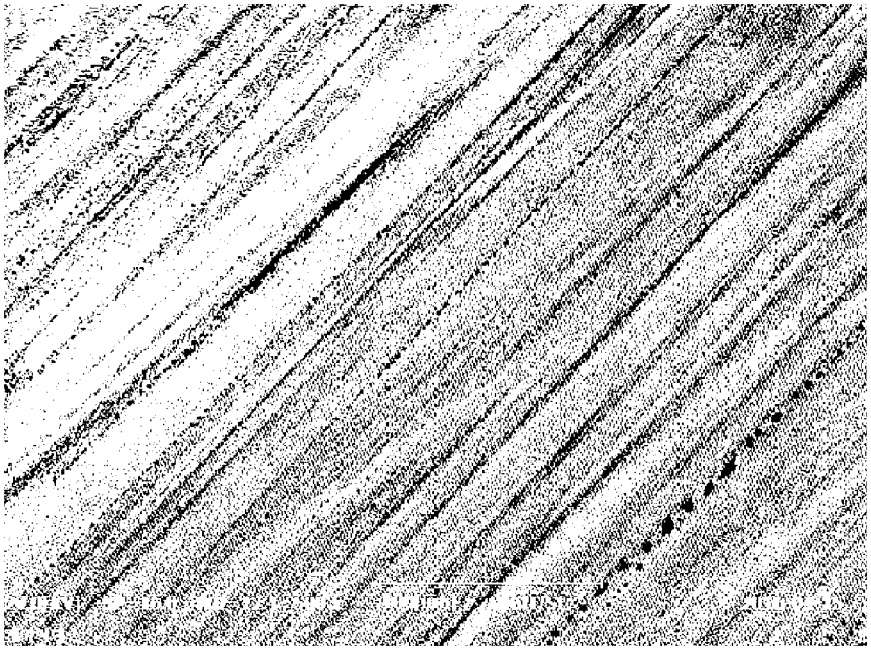
【FIG. 4】
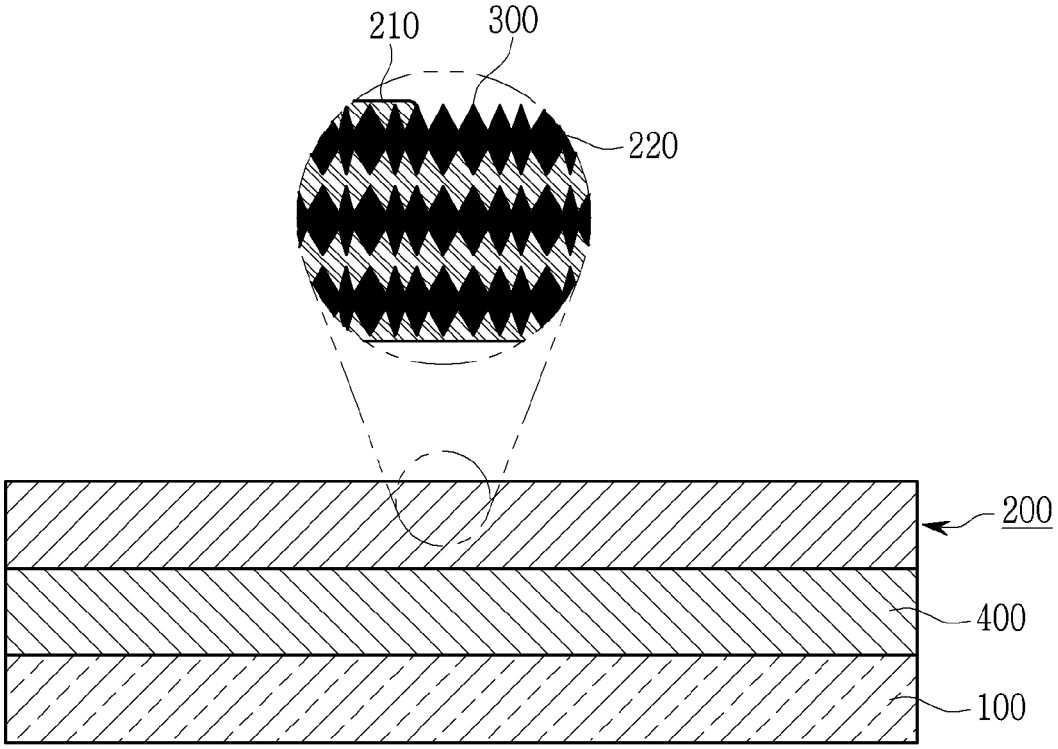

【FIG. 5】
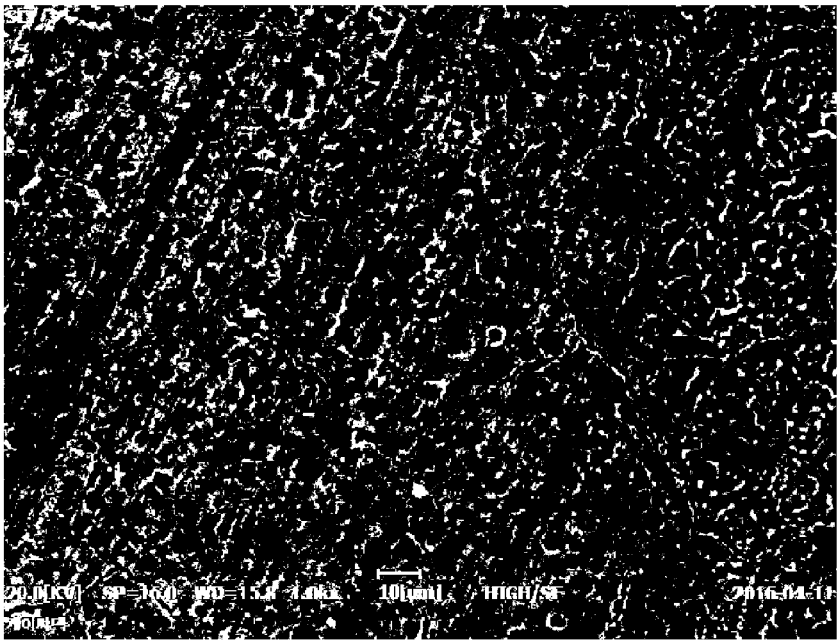
【FIG. 6】
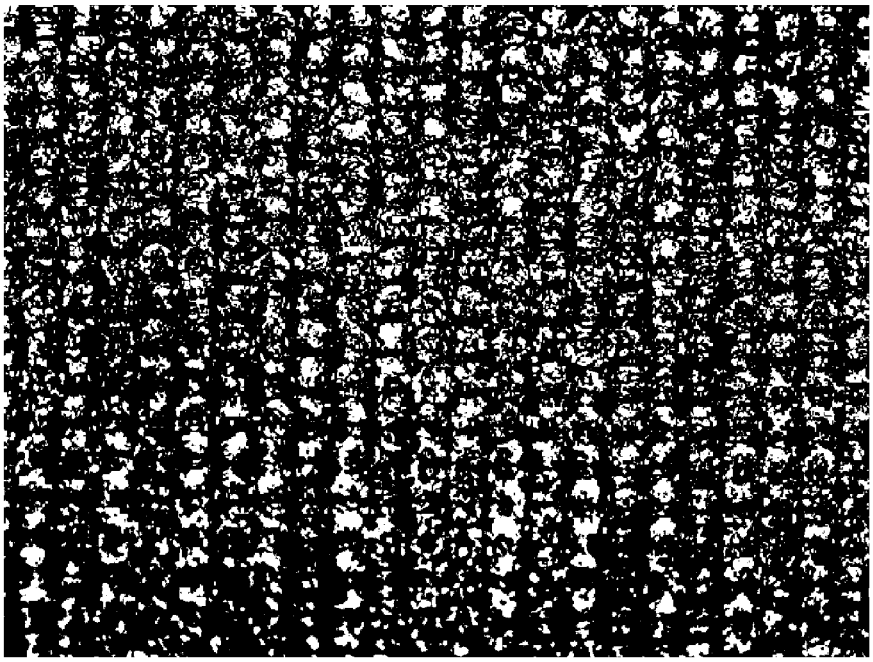

【FIG. 7】
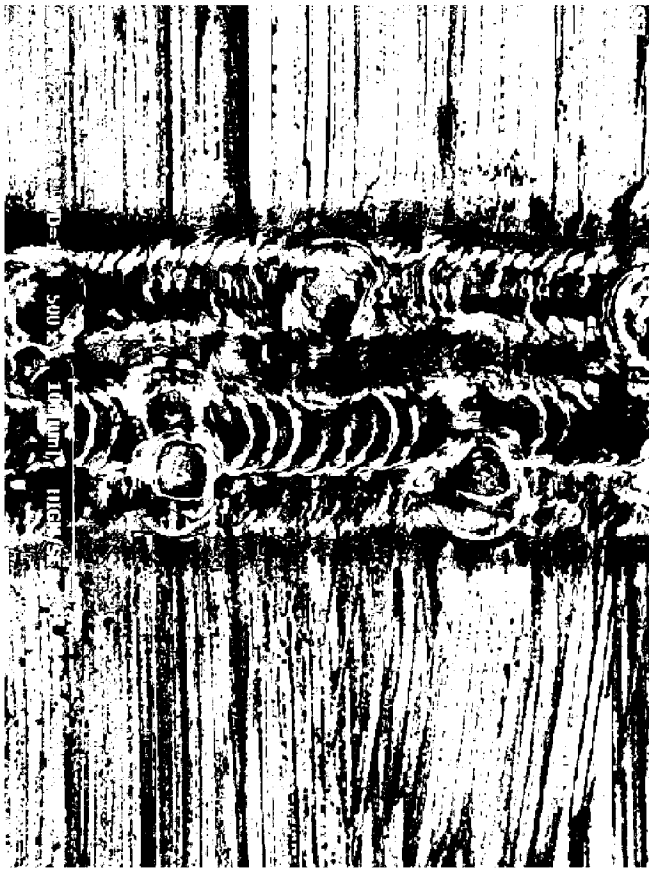
【FIG. 8】
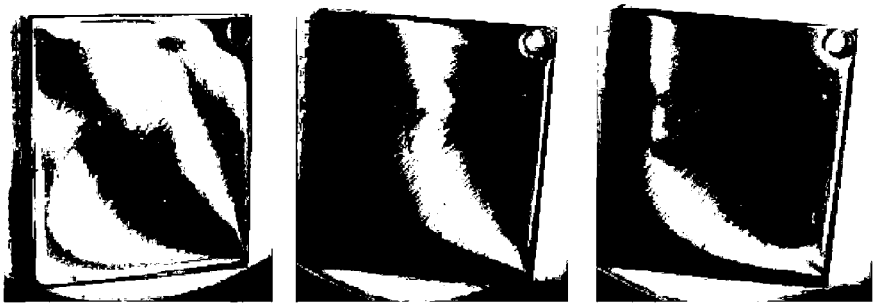

【FIG. 9】
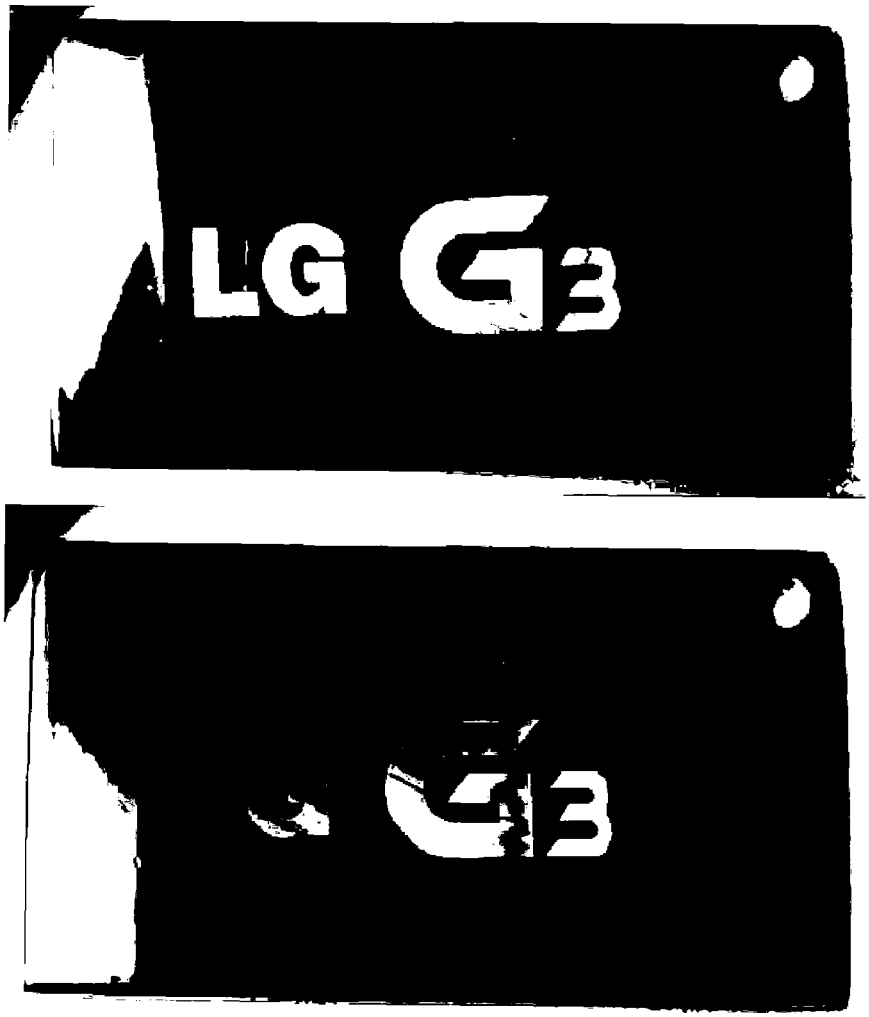

METHOD FOR MANUFACTURING HOLOGRAM PATTERN AND SPECIMEN INCLUDING METAL PLATING LAYER HAVING HOLOGRAM PATTERN ON SURFACE THEREOF

TECHNICAL FIELD

The present invention relates to a method for manufacturing a hologram pattern and a specimen including a metal plating layer having a hologram pattern on surface thereof.

BACKGROUND

In order to induce interests of consumers and improve an image of manufacturers, various kinds of marks such as decorations on bags or wallets or characters, logos, emblems, and the like on buckles or external cases. These marks are formed by etching or shadowing as well as hologram patterns. Recently, the trend has been for marks to employ hologram patterns changed in various colors depending on direction of light to obtain product differentiation and visual effect.

Korean laid-open patent No. 10-0376248 discloses a method of manufacturing window label plate and window label plate including hologram letter. To promote image of manufacturers, hologram letters for displaying company brands are formed on the window plate, which is attached to various kinds of electronic products such as communication devices, TV, VCR, washing machines, and so forth.

The above patent comprises forming a deposition layer by vacuum evaporating a metal on a hard-coating plate, printing silk on a surface of the deposition layer evaporated with the metal, removing a window part and a character part from the deposition layer after printing silk, washing the window label plate after removing the deposition layer, drying the window label plate after washing, processing the window label plate to have a predetermined shape suitable for electronic products, hot stamping where a hologram letter is formed on the character part of the window label plate, and forming an adhesion layer on a surface of the hologram letter after forming the hologram latter through the hot stamping.

In forming holograms on metal components such as external cases of mobile phones, the holograms cannot be directly formed on the metal components. For this reason, holograms are printed and attached in continuously applying heat to thermoplastic using a nickel mold, or hologram letters made of transparent acrylic panels using hot stamping are attached. As a result, these methods have some problems of complex manufacturing process and low yield so that it is not suitable for mass production. Also, the hologram marks by these methods can be easily impaired or damaged without additional protective tapes to be vulnerable to durability and corrosion resistant.

CONTENTS OF THE INVENTION

Technical Object

An object of the present invention to provide a method for manufacturing a hologram pattern and a specimen including a metal plating layer having a hologram pattern on its surface.

Means for Achieving the Object

Pursuant to embodiments of the present invention provides a method for manufacturing a hologram pattern comprising forming a plating layer for creating a hologram pattern by soaking the plating specimen in plating solution for creating a hologram pattern of a plating tank and applying voltage to the plating tank, and creating a pattern where a specimen including a hologram pattern part formed to create unevenness on the surface of the plating layer for creating the hologram pattern by partially or wholly irradiating laser on the surface of the plating layer for creating the hologram pattern is formed. The plating specimen includes a metal plating layer having a hologram pattern thereon.

Pursuant to embodiments of the present invention, the plating layer for creating the hologram includes a first part where unevenness is formed on a surface of a plating specimen and a second part having a strength weaker than the first part.

Pursuant to embodiments of the present invention, the plating solution for creating the hologram pattern is at least one selected from the group consisting of nickel electroplating solution, cobalt electroplating solution, black nickel electroplating solution, silver electroplating solution, gold electroplating solution, and rhodium electroplating solution.

Pursuant to embodiments of the present invention, the plating solution for creating the hologram pattern is nickel electroplating solution and contains nickel sulfamic acid of 400 g to 600 g and nickel chloride of 40 g to 60 g in nickel electroplating solution of 1 L.

Pursuant to embodiments of the present invention, forming a color layer where a color layer is formed on the surface of the specimen having a hologram pattern part thereon through the creating the pattern to manufacture a specimen keeping the hologram pattern of the hologram pattern part on the specimen and having a color is further included.

Pursuant to embodiments of the present invention, the color layer is formed by a color plating and includes at least one selected from the group consisting of a gold plating layer, a black nickel plating layer, a chrome plating layer, a rose-gold plating layer, and combination thereof.

Pursuant to embodiments of the present invention, the hologram pattern part in the creating the pattern is formed by irradiating laser having 500 kHz or more frequency to the plating layer for creating the hologram pattern to form the hologram pattern part on an irradiated portion of the plating layer for creating the hologram pattern.

Pursuant to embodiments of the present invention, the laser is a pulse laser.

Pursuant to embodiments of the present invention, the laser has a pulse length of 30 ns.

Pursuant to embodiments of the present invention provides a specimen including a metal plating layer having a hologram pattern comprising a plating specimen, and a plating layer having a first part partially or wholly covering the plating specimen, formed on the plating specimen, and having unevenness and a second part having a weaker strength than the first part. A hologram pattern part equivalent to an exposed portion of the unevenness of the first part formed by removing the second part on partial or whole surfaces of the plating layer for creating the hologram pattern.

Pursuant to embodiments of the present invention, the hologram pattern part with unevenness is formed through a laser process.

Pursuant to embodiments of the present invention, the plating layer for creating the hologram pattern is at least one selected from the group consisting of a nickel plating layer, a cobalt plating layer, a black nickel plating layer, a silver plating layer, a gold plating layer, and a rhodium plating layer.

Pursuant to embodiments of the present invention, a color layer partially or wholly covering the plating layer for creating the hologram pattern and keeping the hologram pattern of the hologram pattern part on the specimen and having a color is further included.

Pursuant to embodiments of the present invention, the color layer includes at least one selected from the group consisting of a gold plating layer, a black nickel plating layer, a chrome plating layer, a rose-gold plating layer, and combination thereof.

Pursuant to embodiments of the present invention provides a plating solution for creating a hologram pattern containing nickel sulfamic acid of 400 g to 600 g and nickel chloride of 40 g to 60 g in nickel electroplating solution of 1 L as a nickel electroplating solution.

Effect of the Invention

According to the present invention, a hologram pattern can be formed on a metal plating layer with a simple process such as etching after plating.

BRIEF DESCRIPTION OF THE DRAWINGS

FIG. 1 is a SEM (Scanning Electron Microscope, 500 magnifications) photograph of a surface of a specimen in which a plating layer for creating a hologram pattern (Nickel electroplating) is formed according to an embodiment of the present invention;

FIG. 2 is a sectional view of a part of the specimen in which the plating layer for creating the hologram pattern of FIG. 1 according to an embodiment of the present invention;

FIG. 3 is a SEM photograph (500 magnifications) of a hologram pattern part formed by partially irradiating the surface of the plating layer of the specimen according to an embodiment of the present invention;

FIG. 4 is a sectional view of the part of the specimen in which hologram pattern of FIG. 3 is formed according to an embodiment of the present invention;

FIG. 5 is a SEM photograph (1,000 magnifications) of a surface of a plating for creating a hologram having micro cracks in an irregular direction according to an embodiment of the present invention;

FIG. 6 is a SEM photograph (1,000 magnifications) of a micro structure of a surface of a metal after performing a laser marking with respect to the metal according to an embodiment of the present invention;

FIG. 7 is a SEM photograph (500 magnifications) of a micro structure of a surface in which a spot after performing a laser marking with respect to a surface of a specimen where a plating layer is formed according to an embodiment of the present invention;

FIG. 8 is a photograph of a hologram depending on an angle of natural light according to an embodiment of the present invention; and FIG. 9 is a photograph of a hologram depending on an angle of a fluorescent lamp according to an embodiment of the present invention.

DETAILS FOR EXECUTING THE INVENTION

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. Like reference numerals designate like elements throughout the specification.

According to an embodiment of the present invention, a method for manufacturing a hologram pattern comprises forming a plating layer for creating a hologram pattern including a first part where unevenness is formed on a surface of a plating specimen and a second part having a strength weaker than the first part by soaking the plating specimen in plating solution for creating a hologram pattern of a plating tank and applying voltage to the plating tank, and creating a pattern where a specimen including a hologram pattern part formed to create unevenness on the surface of the plating layer for creating the hologram pattern by partially or wholly irradiating laser on the surface of the plating layer for creating the hologram pattern is formed. The plating specimen includes a metal plating layer having a hologram pattern thereon.

In the meanwhile, before irradiating laser on a surface of a plating layer, a hairline process or a burnish process can be performed on the plating layer.

There is visually no difference between the plating layer for creating the hologram pattern and a conventional plating layer. However, the plating layer for creating the hologram pattern has grains, which are parallel each other, under a microscope (500 magnifications). Concretely, the parallel grains are 3 or more, or 3 to 20 per 100 μm (See a SEM photograph of FIG. 1).

The plating layer for creating the hologram pattern has unevenness and includes a first part not appeared on a surface thereof by a second part and the second having a strength weaker than the first part. And, the plating layer for creating the hologram pattern is formed through one plating process. For instance, if electricity flows to nickel plating solution, nickel sulfamic acid and nickel chloride are strongly bonded with a surface of a specimen (a first layer with unevenness is formed) in advance. Then, boric acid, additives, or brighteners together with nickel sulfamic acid and/or nickel chloride are weakly bonded on the first layer (a second layer is formed) to form a surface of a plating layer for creating a hologram pattern.

In the creating the pattern, unevenness of an electricity flow direction becomes appeared by removing the second layer relatively weak in the plating layer for creating the hologram pattern through a laser irradiating process. Due to this unevenness, the hologram pattern can be formed on the specimen.

The parallel grains mean parallel patterns that are 10 or more per 100 μm on the specimen for plating and can be verified under an optical microscope or an electron microscope. As shown in FIGS. 2 and 4, the parallel grains on the plating are verified under the electron microscope, but are equivalent to a conventional smooth plating surface under naked eye. After that, an unevenness structure is easily formed by removing a part of the plating surface toward a thickness direction through an etching process. In this case, the unevenness are relatively parallel and repeated. However, there is no need to have the same intervals of unevenness and they are enough for the hologram pattern to be observed.

The plating layer for creating hologram pattern is formed in a thickness of several hundred nanometer to several micrometer on occasion demands and selectively applicable according to applied voltage level and a creation shape.

The plating specimen 100 (See FIG. 1) is applicable if it can be plated with metal and the size and material thereof are not limited. Before soaking the plating specimen in a plating solution for creating the hologram pattern, a pretreating process such as polishing, cleaning, degreasing, or acidic pickling can be performed with respect to the plating specimen.

Before forming the plating layer for creating the hologram pattern, a base plating layer 400 is formed. Concretely, the base plating layer 400 is a bronze plating layer.

The plating tank is a conventional electroplating tank. The plating tank includes an internal part of the plating tank where plating solution is positioned, an electrode providing constant current to plating solution, and power supply connected to the electrode.

The plating solution for creating the hologram is a plating solution capable of forming a plating layer 200 for creating a hologram pattern on the surface of the plating specimen (See FIG. 1). Concretely, the plating solution for creating the hologram pattern is nickel electroplating solution and contains as a nickel source nickel sulfamic acid of 400 g to 600 g and nickel chloride of 40 g to 60 g in nickel electroplating solution of 1 L. In this case, a nickel electroplating process is smoothly performed so that a plating layer having a surface with parallel grains under the above-mentioned microscopes is formed.

The plating solution for creating the hologram pattern is not limited to the nickel electroplating solution. In addition, the plating solution for creating the hologram pattern can be formed on a cobalt gloss electroplating layer, a black-nickel gloss electroplating layer, silver electroplating layer, or rhodium electroplating layer. In more detail, the plating solution for creating the hologram pattern can be efficiently formed on a cobalt gloss electroplating layer, a black-nickel gloss electroplating layer, or a nickel gloss electroplating layer.

If the plating solution for creating the hologram pattern is the nickel gloss electroplating solution, the nickel sulfamic acid of 6 to 15 weight ratio with respect to the nickel chloride of 1 weight ratio. Additionally, the nickel sulfamic acid of 8 to 12 weight ratio with respect to the nickel chloride of 1 weight ratio.

By applying the above-mentioned proportion ratio of the nickel sulfamic acid and nickel chloride, a plating layer with minute grains can be obtained. If the nickel sulfamic acid is under 6 weight ratio or excesses 15 weight ratio with respect to the nickel chloride of 1 weight ratio, a plating layer with minute grains is not formed and there are no smooth grains under a microscope. As a result, a plating layer with a shape formed by micro cracks in an irregular direction can be obtained (See FIG. 5).

In case of the nickel sulfamic acid of 8 to 12 weight ratio with respect to the nickel chloride of 1 weight ratio, a plating layer for creating a hologram in which a vivid hologram is formed can be formed through an etching process.

The nickel electroplating solution further includes a stabilizer and a brightener except for the nickel sulfamic acid and nickel chloride.

The stabilizer (a buffer) performs a function buffer pH, which is changeable during electroplating, improves smoothness of a plating surface, and helps uniform electrode position. The stabilizer is boric acid but is not limited thereto. If boric acid is used as the stabilizer of the nickel electroplating solution, the stabilizer contains 50 g or more boric acid with respect to nickel electroplating solution of 1 L. Concretely, the stabilizer contains boric acid of 50 g to 150 g with respect to nickel electroplating solution of 1 L. If boric acid is contained within the above-mentioned range, the plating layer for creating the hologram pattern can be stably formed.

The brightener is needed in order to form a gloss plating layer. It is preferable that the hologram pattern formed on the specimen is formed on a glossy surface.

The brightener applicable to metal plating is also used and can be controlled in proper amount.

The plating solution for creating the hologram pattern is polar solvent such as water and further includes a feet anti-sagging agent (surfactants and the like) or an inter-stress mitigator.

Voltage is applied to the plating tank. Then, a constant current density is created by the applied voltage in the plating tank. By electro-chemical reaction, the plating layer is formed on the plating specimen.

In this case, a conventional plating process is applicable except for the above-mentioned explanations. For instance, a plating process can be smoothly performed on condition that a plating temperature is ranging from 30° C. to 60° C., a current density of 1 to 150 mA/cm$^2$, and an applied voltage of 0.1 to 10V.

In the creating the pattern, a hologram pattern part including an unevenness structure repeated in parallel on partial or whole surface of the plating layer for creating the hologram pattern to form a specimen with a hologram pattern.

The creating the pattern is a process for more clearing minute grains on the surface of the plating layer for creating the hologram pattern.

Concretely, a laser irradiating can be performed in the creating the pattern. By light and energy of laser, the minute grains on the surface of the plating layer is transformed into an unevenness structure. In this case, the shape of the pattern or the amount of the hologram pattern can be controlled depending on the intensity or direction of irradiated laser.

In this case, spots are not formed on a surface of plating in the forming the pattern part using the laser irradiating.

By applying a conventional surface treatment using laser, a metal surface with constant minute surface structure can be obtained on a metal specimen (not the plating layer). That is, the metal surface includes a laser marking (See FIG. 6). In other words, it is checked that spots having constant size are repeatedly formed and the shape of the metal surface is modified by irradiating laser to have spot patterns constantly repeated. On the other hand, if a conventional laser is applied to the plating layer for creating the hologram pattern, the plating layer becomes crushed and overlapped by the spots so that it is difficult to form a constant pattern or a hologram pattern.

The laser of the present invention has 500 kHz or more frequency, and more concretely, is ranging from 500 kHz to 1,000 kHz.

If the frequency of the laser is under 500 kHz, a weak part of the plating (a second part) is not etched by the unevenness on the plating layer for creating the hologram pattern irradiated by the laser and the plating layer is only etched by a laser beam spot so that the hologram may not be formed.

Additionally, the laser may be a pulse laser and have a pulse length under 30 ns. The laser may have a pulse length ranging from 5 ns to 30 ns. Concretely, the laser may have a pulse length ranging from 7 ns to 20 ns or 9 ns to 15 ns.

If the pulse laser within the above-mentioned range, a laser with an energy lower than a conventional laser is irradiated to the plating layer. As a result, a spot is not formed on a surface of the plating layer, and a part of the plating surface and a portion weakly bonded with heat 200 (See FIG. 2) are removed and a portion strongly bonded with heat 220 (See FIG. 2) is nor removed. Thus, an evenness 300 (See FIG. 4) is vividly appeared on the hologram pattern part and the gloss of the plating layer 200 itself becomes disappeared to form a hologram pattern appeared in various colors depending on the light direction.

In this case, this unevenness 300 is regularly repeated. Accordingly, when incident light on the surface of the specimen is reflected, interference occurs. The reflected light to have modified wavelength due to the interference is appeared in various colors depending on the location of observers so that a hologram pattern can be shown on the plating layer.

The unevenness for making the hologram pattern appear is repeated in parallel. The shape of the unevenness is clearly distinguished from the plating layer not through the creating the pattern.

Under an electron microscope, the intervals of the unevenness appeared as a micro-lattice pattern of the hologram pattern part may be under 5 μm, 2 μm, and ranging from 0.05 μm to 1 μm.

The method for manufacturing the hologram pattern further includes forming a color layer where a color layer is formed on the surface of the specimen having a hologram pattern part thereon through the creating the pattern to manufacture a specimen keeping the hologram pattern of the hologram pattern part on the specimen and having a color.

The color layer may be formed by a color plating. A conventional color plating is applicable. A gold plating, a black nickel plating, a chrome plating, or a rose-gold plating layer may be employed as the color plating and selectively applicable according to user intent.

According to a method for manufacturing a hologram pattern of the present invention, the hologram pattern is applied to a metal plating layer (not a metal specimen). Accordingly, materials which can be plated are widely applicable. The hologram pattern, which becomes appeared in various colors depending on light and user's vision, can be formed with a simple process. If a hologram pattern is formed using a polymer film and plated with gold to be attached with a specimen, the durability thereof may be reduced. According to the present invention, a hologram pattern is formed on a plating layer itself to have excellent durability.

The specimen including a metal plating layer having a hologram pattern according to the present invention comprises a plating specimen and a plating layer having a first part partially or wholly covering the plating specimen, formed on the plating specimen, and having unevenness and a second part having a weaker strength than the first part.

A hologram pattern part equivalent to an exposed portion of the unevenness of the first part formed by removing the second part on partial or whole surfaces of the plating layer for creating the hologram pattern is further included.

The plating layer for creating the hologram pattern has grains in parallel under a microscope. The hologram pattern part including an unevenness structure (lattice pattern) repeated in parallel is positioned on partial or whole surfaces of the plating layer for creating the hologram pattern.

The parallel grains are 3 or more, or 3 to 20 per 100 μm and observed under a microscope (500 magnifications).

For example, as shown in FIG. 1 or 3, the parallel grains on the plating are verified under the electron microscope, but are equivalent to a conventional smooth plating surface under naked eye. After that, an unevenness structure is easily formed by removing a part of the plating surface toward a thickness direction.

The plating layer for creating the hologram pattern is formed in a thickness under 100 μm, and concretely, ranging from 7 μm to 100 μm and has gloss on a surface thereof.

The unevenness for making the hologram pattern appear is repeated in parallel. The shape of the unevenness is clearly distinguished from the plating layer not through the creating the pattern.

Under an electron microscope, the intervals of the unevenness appeared as a micro-lattice pattern of the hologram pattern part may be under 5 μm, 2 μm, and ranging from 0.05 μm to 1 μm. On condition that this lattice pattern is formed of an unevenness pattern, a hologram pattern, which is appeared in various colors depending on light and a position of a user, can be efficiently provided.

The specimen may be accessories, decoration materials (including materials attached to bags, clothes, and the like), electronic cases, exterior materials, and so forth.

The plating layer for creating the hologram pattern is a nickel plating layer, a cobalt plating layer, a black nickel plating layer, a silver plating layer, a gold plating layer, and a rhodium plating layer or a gloss plating layer.

The specimen further includes a color layer partially or wholly covering the plating layer for creating the hologram pattern and keeping the hologram pattern of the hologram pattern part on the specimen and having a color. To avoid description duplication, their description of the color layer is omitted herein.

Also, the specimen including a metal plating layer having a hologram pattern on the surface thereof further includes a protection layer, a contamination reduction layer, and so forth on occasion demands.

The plating solution for creating the hologram pattern according to an embodiment of the present invention is nickel electroplating solution and contains nickel sulfamic acid of 400 g to 600 g and nickel chloride of 40 g to 60 g in nickel electroplating solution of 1 L.

To avoid description duplication, their description of the plating solution is omitted herein.

Hereinafter, examples according to the present invention will be described.

Nickel sulfamic acid and nickel chloride containing the amount shown in the following Table 1, and nickel electroplating solution including brighteners were manufactured respectively and then positioned in the plating tank.

TABLE 1

| g/L | Com. Example | Example 1 | Example 2 | Example 3 |
|---|---|---|---|---|
| Nickel sulfamic acid | 731.2 | 530.2 | 486.4 | 531.7 |
| Nickel chloride | 92.9 | 45.6 | 53.5 | 52.3 |
| Boric acid | 80.4 | 83.5 | 98.3 | 68.4 |

As shown in Table 1, a plating solution in which a hologram is not formed after etching was described in Comparative Example, and a plating solution in which a hologram is formed was described in Examples 1, 2, and 3.

Water was used as solvents of the nickel electroplating solution and the brighteners were contained in an amount as much as recommended allowance amount. A pretreated specimen was positioned in the nickel electroplating solution, and an electroplating was performed by applying voltage to the plating tank. As a result, the specimen including a nickel plating layer having excellent brightness and smooth surface was obtained.

After washing and drying the plated specimen, patterns were formed using laser. In this case, the laser was a pulse laser. Then, a hologram pattern with minute unevenness on a surface thereof was formed by irradiating a predetermined pattern in fine focusing. In addition, a gold color plating and a black-nickel plating were additionally performed to partial specimen to manufacture the specimen with gold color or black color.

Based on the observation results of the specimen under natural light and a florescent lamp, it was checked that the hologram pattern on the plating layer according to the present invention was fine and excellent (See FIGS. 8 and 9).

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A method for manufacturing a hologram pattern, the method comprising:

immersing a plating specimen in a plating tank containing a plating solution and applying a voltage to the plating specimen to form a plating layer on the surface of the plating specimen;

creating a pattern on the plating specimen including a hologram pattern on the surface of the plating layer, wherein the hologram pattern is created by irradiating a laser on the surface of the plating layer to remove a portion of the plating layer, wherein the laser is a pulse laser and has a pulse length of 5 ns to 30 ns, wherein the pulse laser has a frequency of 500 kHz to 1,000 kHz, and wherein irradiating the surface of the plating layer to create the hologram pattern comprises forming an unevenness in the surface of the plating layer that is repeated in parallel and an interval of the unevenness is 0.05 μm to 1 μm.

2. The method of claim 1, wherein the plating solution is at least one selected from the group consisting of a nickel electroplating solution, a cobalt electroplating solution, a black nickel electroplating solution, a silver electroplating solution, a gold electroplating solution and a rhodium electroplating solution.

3. The method of claim 1, further comprising forming a color layer wherein the color layer is formed on the surface of the plating specimen having the hologram pattern thereon.

4. The method of claim 3, wherein the color layer is formed by color plating and includes at least one selected from the group consisting of a gold plating layer, a black nickel plating layer, a chrome plating layer, a rose-gold plating layer and a combination thereof.

5. The method of claim 1, wherein the plating solution is a nickel electroplating solution and contains nickel sulfamic acid of 400 g to 600 g and nickel chloride of 40 g to 60 g in 1 liter of the plating solution.

6. The method of claim 1, wherein the plating layer has a thickness of 7μ to 100 μm.

* * * * *